US007168967B1

(12) United States Patent
Yen

(10) Patent No.: US 7,168,967 B1
(45) Date of Patent: Jan. 30, 2007

(54) HUB STRUCTURE

(76) Inventor: Hsu-Li Yen, 3F-2, No. 13, Wu Chuan 1 Rd., Hsin Chuang City, Taipei Hsien (TW)

( * ) Notice: Subject to any disclaimer, the term of this patent is extended or adjusted under 35 U.S.C. 154(b) by 0 days.

(21) Appl. No.: 11/482,941

(22) Filed: Jul. 10, 2006

(51) Int. Cl.
*H01R 3/00* (2006.01)

(52) U.S. Cl. ..... 439/164

(58) Field of Classification Search ..... 439/501, 439/15, 16, 164, 162, 446, 534
See application file for complete search history.

(56) References Cited

U.S. PATENT DOCUMENTS 5,810,606 A * 9/1998 Ballast et al. ..... 439/15
5,865,634 A * 2/1999 Best ..... 439/164
5,917,163 A * 6/1999 Lecznar et al. ..... 200/61.54
5,928,018 A * 7/1999 Dumoulin ..... 439/164
6,095,836 A * 8/2000 Bolen et al. ..... 439/164
6,213,797 B1 * 4/2001 Best et al. ..... 439/164
6,860,745 B1 * 3/2005 Bolen et al. ..... 439/164

* cited by examiner

*Primary Examiner*—Michael C. Zarroli
(74) *Attorney, Agent, or Firm*—Rosenberg, Klein & Lee

(57) ABSTRACT

It is the primary object of the invention to provide an improved structure of a hub, said hub having two cables that are drawn out and recoiled independently thereof; whereby the cable lengths are adjusted in a multitude of stages to the desired length, and means mounted in said hub to smoothly recoil the cables.

2 Claims, 5 Drawing Sheets

HUB STRUCTURE

BACKGROUND OF THE INVENTION

1. Field of the Invention

The present invention relates to an improved structure of a hub, which is used for the control over drawing out and rolling up the cables of manifold electric devices, computers and communication equipment.

2. Description of the Related Art

With the ceaseless progression of technology, the structures of computer, electronic and communication equipment are developed to meet the requirements of the present market. However, it is always inconvenient to store the cables of these devices. To solve the problem, various kinds of hubs are provided to collect the cables and control their length during use.

Referring to FIG. 1, a hub 10 is utilized by pulling out cables 101 at its ends by hand, which is single-staged. That is, the cables 101 are not fixed in place until the both ends are completely drawn out. In order to recoil cables 101, users need to drag and release cables 101 at two ends simultaneously, and thereby cables 101 are automatically recoiled. Another kind of hub 10 belongs to a multi-staged type, of which cables 101 are drawn out and fixed in multiple stages. Though cables 101 can be fixed in multiple stages while being pulled, it is difficult to define the length of the cables 101 and then readjust. Moreover, it is still unfavorable to pull and drag cables 101 at both ends simultaneously because the process needs to be repeated several times for the entire length of cables 101.

In view of the aforesaid disadvantages, a hub having two cables that can be separately adjusted in multiple stages while pulling out the cables and can be recoiled smoothly is required. Therefore, an improved structure of a hub that satisfies the practical concerns of convenience and utility is investigated and provided in the invention.

The aspects of structures, as well as many of the attendant advantages and features of this invention will become more apparent by reference to the following detailed description, when taken in conjunction with the accompanying drawings.

SUMMARY OF THE INVENTION

It is the primary object of the invention to provide an improved structure of a hub, said hub having two cables that are drawn out and recoiled independently thereof; whereby the cable lengths are adjusted in a multitude of stages to the desired length, and means mounted in said hub to smoothly recoil the cables.

DETAILED DESCRIPTION OF THE INVENTION

Figure 1:
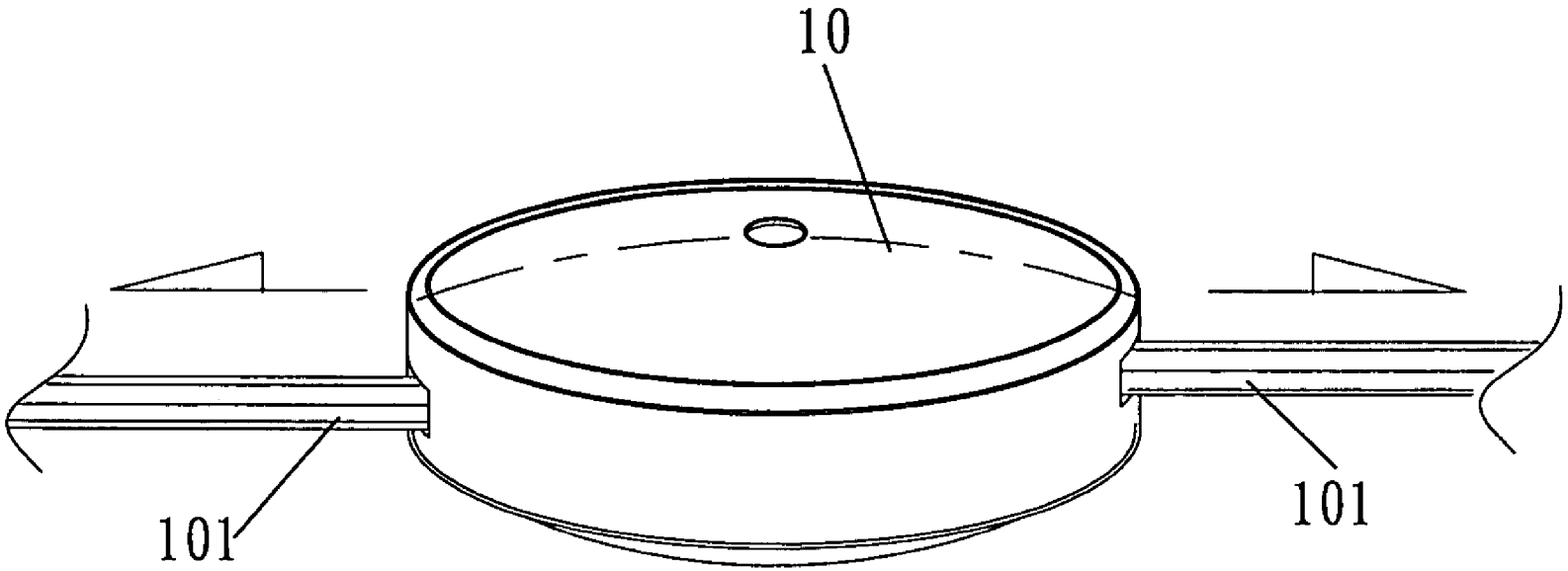
Fig. 1 (Prior Art)
FIG. 1 illustrates operation of a hub according to the prior art.
Figure 2:
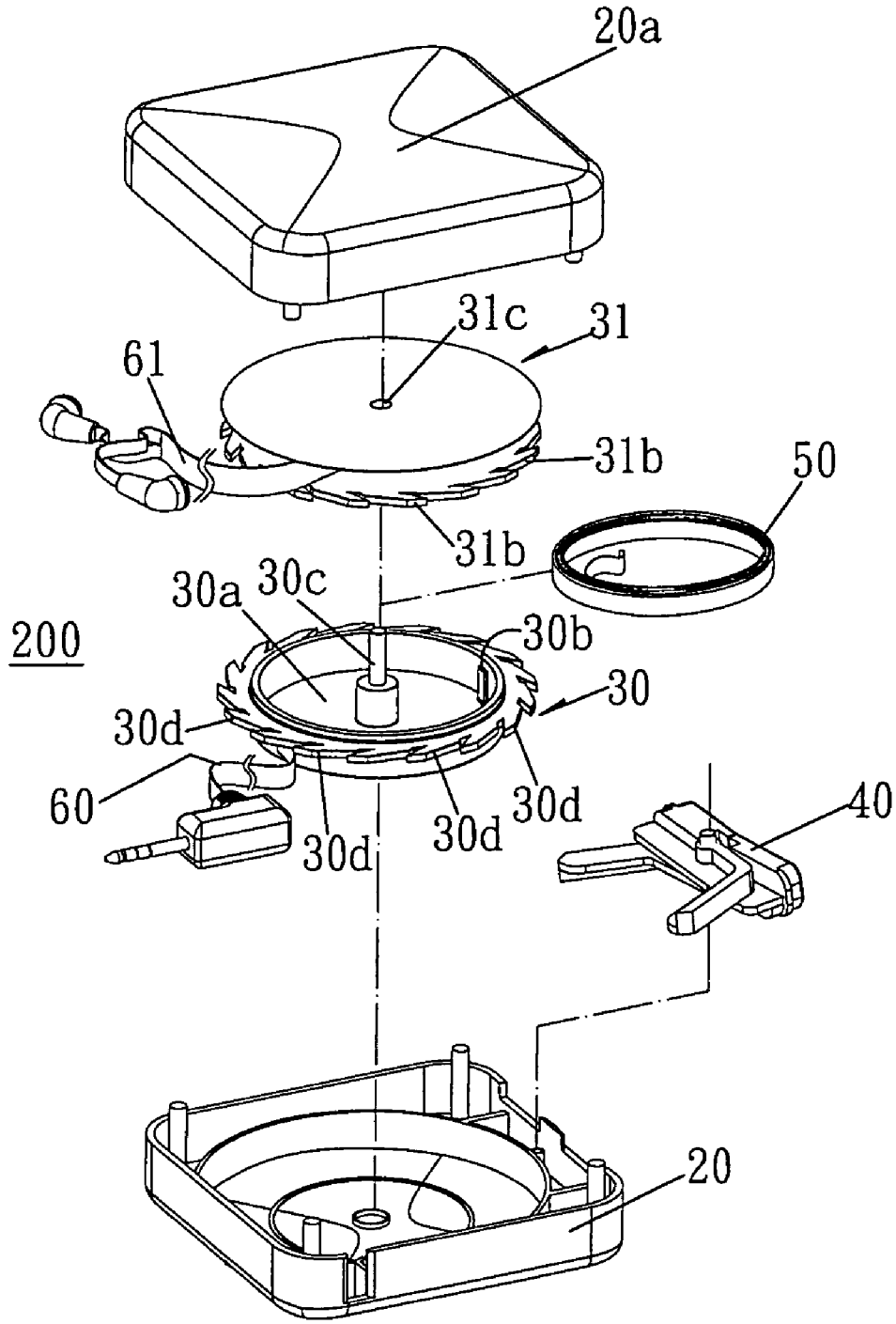
FIG. 2 is an exploded view of a hub according to an embodiment of the invention.
Figure 3:
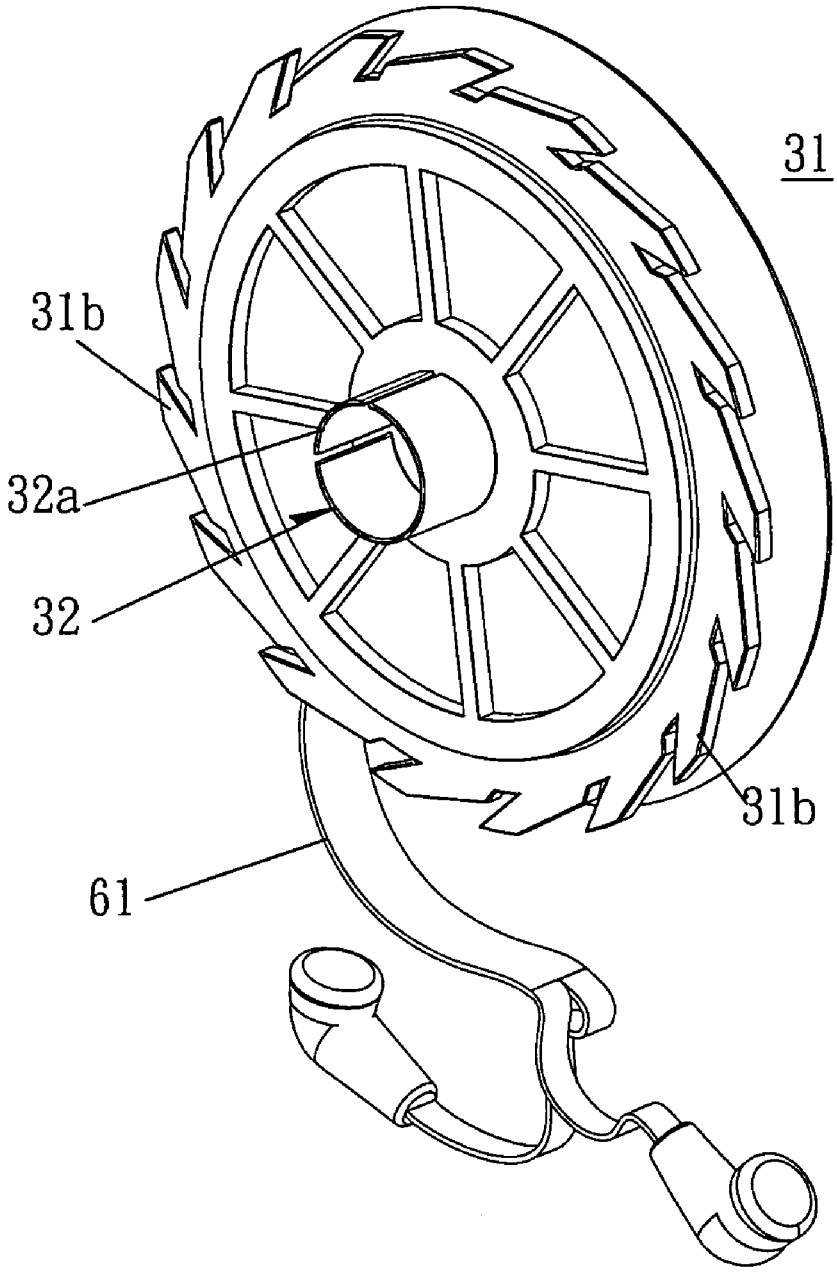
FIG. 3 is a perspective view of a rotating disc of a hub according to an embodiment of the invention.
Figure 4:
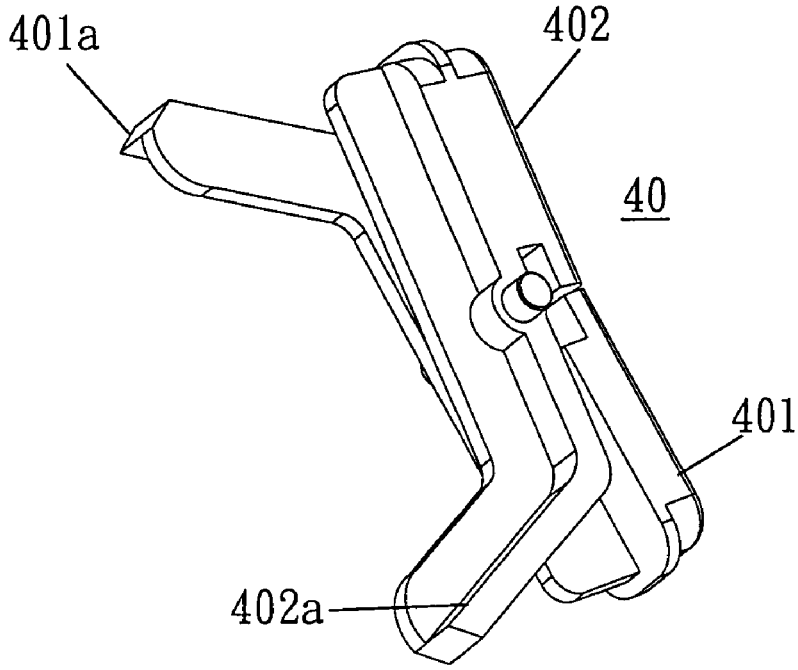
FIG. 4 is a perspective view of a button switch device of a hub according to an embodiment of the invention.
Figure 4:
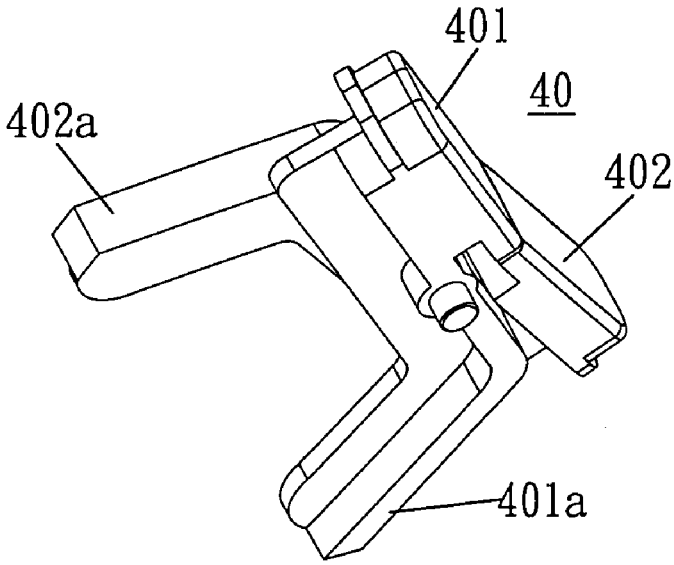
Figure 5:
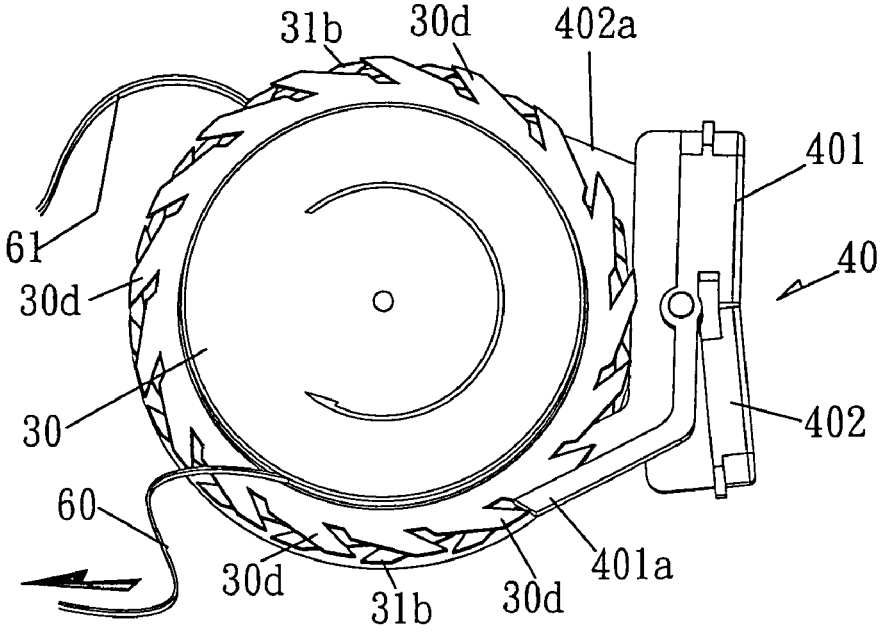
FIG. 5 shows a rotating disc and a button switch device while pulling out the cables of a hub according to an embodiment of the invention.

FIG. 2 is an exploded diagram of a hub according to an embodiment of the invention, having a socket 20, a cap 20*a*, two rotating discs 30, 31, a reel 50, and a button switch device 40 as shown. A rotating disc 30 has a reel trench 30*a* therein, a protruding hook support 30*b* and a connecting axis 30*c* disposed in the center to connect with an end of a cable 60 surrounding rotating disc 30. Ratchets 30*d* are further positioned around the periphery of rotating disc 30. Referring to FIG. 3, rotating disc 31 having an axial through hole 31*c* and a spool 32 extending thereof, in which an opening is deployed to form a hook support 32*a*. Axial through hole 31*c* is connected to an end of a cable 61 surrounding rotating disc 31, and ratchets 31*b* are positioned around the periphery of rotating disc 31. Reel trench 30*a* of rotating disc 30 is provided for the placement of the reel 50. One end of the reel 50 clasps a hook support 30*b* of reel trench 30*a*, and the other end of reel 50 clasps hook support 32*a* of rotating disc 31 in reference with FIG. 3. Connecting axis 30*c* of rotating disc 30 is inserted into axial through hole 31*c* of rotating disc 31 such that cables 60, 61 of rotating discs 30, 31 are coupled. The resultant structure is arranged over socket 20, and button switch device 40 is disposed on the side thereof. Cap 20*a* covers the combination, and constitutes a hub 200. Button switch device 40 (FIG. 4) having two buttons 401, 402 thereof, having pivotal arms 401*a*, 402*a*, respectively, are intersected. A spring is disposed corresponding to the axial through hole 31*c* and set into the axle center to join buttons 401, 402 together. Referring to FIG. 5, pivotal arms 401*a*, 402*a* separately obstruct ratchets 30*d*, 31*b* of rotating discs 30, 31, and preventing rotating discs 30, 31 from recoiling cables 60, and 61.

FIG. 5 shows a rotating disc and a button switch device while pulling out the cables of a hub according to an embodiment of the invention. As shown, cable 60 is coiled around rotating disc 30, whereby cable 60 is drawn out by hand and rotating disc 30 rotates smoothly. (Also referring to FIG. 2, reel 50 inside reel trench 30*a* of rotating disc 30 is synchronously turned and constricted.) Cable 60 is released without retardation from pivotal arm 401*a* of button switch device 40. Cable 60 not being pulled is opposed by tension induced by reel 50 of rotating disc 30 and drives the reverse rotation of rotating disc 30. As a result, ratchets 30*d* of rotating disc 30 catch pivotal arm 401*a* and ceases to move.

Figure 6:
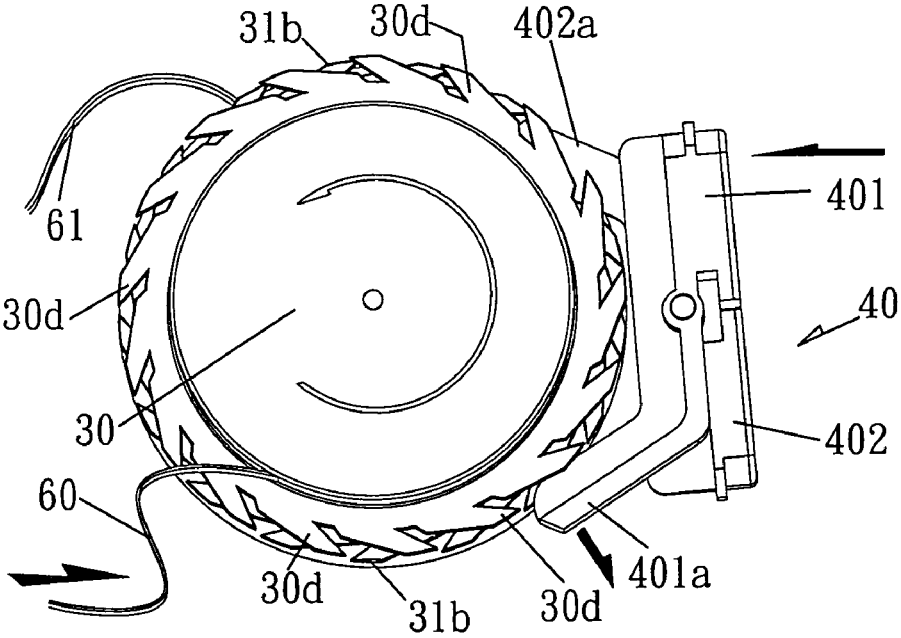
FIG. 6 shows a rotating disc and a button switch device while recoiling the cables of a hub according to an embodiment of the invention.

FIG. 6 shows a rotating disc and a button switch device while recoiling the cables of a hub according to an embodiment of the invention. As shown, to recoil cable 60, pivotal arm 401*a* departs from ratchets 30*d* of rotating disc 30 when button 401 of the button switch device 40 is pressed. Accordingly, tension is induced by reel 50 of rotating disc 30 and drives the rotation of rotating disc 30 to recoil cable 60.

Furthermore, the relationship between rotating disc 31 and button switch device 40 during recoiling or drawing out cable 61 is similar to that described in FIGS. 5 and 6, which is not disclosed in more detail hereinafter.

In accordance with the description above, the hub of the present invention possesses the benefit of drawing out and recoiling a single cable. The structure is not known to the public, and has utility and novelty. It is appreciated if the application is examined and granted.

The aforementioned embodiments of the present invention are intended to be illustrative only. It will be apparent to those skilled in the art that numerous alternative embodiments could be made without departing from the scope of the invention.

What is claimed is:

1. An improved hub including a socket, a cap, two rotating discs, a reel, and a button switch device, wherein the improvement comprises that one of the rotating discs includes a reel trench therein, a protruding hook support thereon, a connecting axis disposed in the center of the rotating disc to connect with an end of a cable surrounding the rotating disc, and a plurality of ratchets disposed around the periphery of the rotating disc, and the other rotating disc having an axial through hole connected to an end of a cable surrounding the rotating disc, an extended spool having an opening deployed to form a hook support and a plurality of ratchets positioned around a periphery of the rotating disc, wherein the reel trench of the rotating disc is provided for positioning the reel, an end of the reel clasps the hook support of the reel trench, and another end of the reel clasps the hook support of the other rotating disc, the connecting axis of the rotating disc is inserted into the axial through hole of the other rotating disc such that the cables of the two rotating discs are coupled to each other, a resultant structure thereby is arranged over the socket, the button switch device is disposed on a side thereof, and the cap covers the socket, so as to constitute a hub.

2. The improved hub of claim 1, wherein the button switch device comprises two buttons having independent pivotal arms and intersecting each other, and a spring disposed corresponding to an axle hole of one of the pivotal arms and set into an axle center of the other arm to join the buttons together, wherein the pivotal arms obstruct the ratchets of the two rotating discs, respectively, preventing the rotating discs from being turned to recoil the cables.

* * * * *